US008186807B2

(12) United States Patent
Kijima et al.

(10) Patent No.: US 8,186,807 B2
(45) Date of Patent: May 29, 2012

(54) ACTUATOR, METHOD FOR MANUFACTURING ACTUATOR, DROPLET EJECTION DEVICE, DROPLET EJECTION HEAD AND PRINTER

(75) Inventors: Takeshi Kijima, Saitama (JP); Minoru Usui, Shiojiri (JP)

(73) Assignee: Seiko Epson Corporation (JP)

( * ) Notice: Subject to any disclaimer, the term of this patent is extended or adjusted under 35 U.S.C. 154(b) by 613 days.

(21) Appl. No.: 12/393,126

(22) Filed: Feb. 26, 2009

(65) Prior Publication Data

US 2009/0219343 A1 Sep. 3, 2009

(30) Foreign Application Priority Data

Feb. 29, 2008 (JP) ..... 2008-050453

(51) Int. Cl.
*B41J 2/14* (2006.01)

(52) U.S. Cl. ..... 347/53; 347/68; 347/70; 347/71

(58) Field of Classification Search ..... 347/53, 347/68–72
See application file for complete search history.

(56) References Cited

U.S. PATENT DOCUMENTS 5,434,549 A 7/1995 Hirabayashi et al.
5,472,323 A * 12/1995 Hirabayashi et al. ..... 417/417

FOREIGN PATENT DOCUMENTS

| | | |
|---|---|---|
| JP | 06-044384 | 6/1994 |
| JP | 2001-112228 | 4/2001 |
| JP | 2001-268883 | 9/2001 |
| JP | 2004-023830 | 1/2004 |
| JP | 2005-130603 | 5/2005 |

* cited by examiner

*Primary Examiner* — Matthew Luu
*Assistant Examiner* — Henok Legesse
(74) *Attorney, Agent, or Firm* — Harness, Dickey & Pierce, P.L.C.

(57) ABSTRACT

A droplet ejection device includes a pressure chamber that includes a cavity surrounded by a side wall and a bottom wall, a deformable substrate that is provided above the pressure chamber to cover the cavity and that is parallel to the bottom wall, a magnetic body having an opening that is provided above the deformable substrate and that is fixed to the deformable substrate, and a coil that is disposed above the deformable substrate, that surrounds the magnetic body, and that is fixed to a fixing portion provided above the side wall.

8 Claims, 6 Drawing Sheets

ACTUATOR, METHOD FOR MANUFACTURING ACTUATOR, DROPLET EJECTION DEVICE, DROPLET EJECTION HEAD AND PRINTER

CROSS-REFERENCE TO RELATED APPLICATION

This application claims a priority to Japanese Patent Application No. 2008-050453 filed on Feb. 29, 2008 which is hereby expressly incorporated by reference herein in its entirety.

BACKGROUND

1. Technical Field

The present invention relates to actuators, methods for manufacturing actuators, droplet ejection devices, droplet ejection heads and printers having the droplet ejection heads.

2. Related Art

As droplet ejection heads for discharging liquid, inkjet heads that may be mounted, for example, on an ink jet recording apparatus are known. Inkjet heads may use an ink jetting method in which pressure chambers communicating with nozzle apertures are pressurized by piezoelectric elements thereby ejecting ink droplets through the nozzle apertures. As the piezoelectric elements, laminate type piezoelectric elements formed from alternately laminated piezoelectric layers and electrode layers are known. Piezoelectric material such as lead titanate zirconate is used for such piezoelectric elements. In recent years, the influences of lead that would impact the natural environment have become concerns, and therefore studies have been conducted to reduce the use of lead.

SUMMARY

In accordance with an advantage of some aspects of the invention, a novel actuator that does not use piezoelectric material and a method for manufacturing the same can be provided. Also, in accordance with another aspect of the invention, a droplet ejection device, a droplet ejection head and a printer including the actuator can be provided.

An actuator in accordance with an embodiment of the invention includes a deformable substrate, a magnetic body having an opening, provided above the substrate, and a coil that is disposed above the substrate and surrounds the magnetic body.

According to the actuator recited above, desired vibrational operations can be achieved with a relatively simple structure.

In the description of the invention, the term "above" is used, for example, as in a statement "a specific component (hereinafter called 'B') is formed "above" another specific component (hereinafter called 'A')." In such a case, the term "above" is used in the description of the invention, while assuming to include the case where the component B is formed directly on the component A and the case where the component B is formed over the component A through another component provided on the component A. Similarly, the term "below" is used, while assuming to include the case where the component B is formed directly under in contact with the component A and the case where the component B is formed under the component A through another component.

In the actuator in accordance with an aspect of the invention, the magnetic body is formed from a plurality of unit magnetic bodies that are divided along an up-down direction, and the coil is formed from unit coils that are divided in the up-down direction, wherein adjacent ones of the unit coils in the up-down direction are connected to each other in the up-down direction by a connector formed from a magnetic material.

In the actuator in accordance with an aspect of the invention, an interlayer dielectric layer may be provided between the unit magnetic body and the unit coil in the up-down direction.

The actuator in accordance with an aspect of the invention may include a fixing section that is provided above the substrate, to which the coil is fixed.

In the actuator in accordance with an aspect of the invention, the substrate may vibrate according to up-down movements of the magnetic body.

A method for manufacturing an actuator in accordance with another embodiment of the invention pertains to a method for manufacturing an actuator including a substrate, and a magnetic body and a coil surrounding the magnetic body above the substrate, and the method includes the steps of: forming a unit magnetic body composing a part of the magnetic body above the substrate; forming a unit coil composing a part of the coil above the substrate; forming a dielectric layer that covers the unit magnetic body and the unit coil above the substrate; and forming a connector to be connected to the unit coil on the dielectric layer, wherein the steps of forming the unit magnetic body, the unit coil, the dielectric layer and the connector are repeated, thereby laminating the unit magnetic body and the unit coil in an up-down direction with the dielectric layer interposed between the unit magnetic body and the unit coil.

According to the manufacturing method described above, an actuator in accordance with the embodiment of the invention can be manufactured with high precision by using a semiconductor manufacturing technology.

A droplet ejection device in accordance with another embodiment of the invention includes any one of the actuators described above, and further includes a pressure chamber having a cavity below the substrate, wherein a bottom wall of the pressure chamber has a nozzle aperture.

In the droplet ejection device in accordance with an aspect of the invention, the substrate may have an opening section, wherein the opening section communicates with an opening section provided in the magnetic body and the cavity.

In the droplet ejection device in accordance with an aspect of the invention, the actuator has a plane configuration that may be a hexagon.

A droplet ejection head in accordance with an embodiment of the invention includes any one of the droplet ejection devices in plurality.

In the droplet ejection head in accordance with an aspect of the invention, the plural droplet ejection devices may be arranged in a honeycomb configuration in a plan view.

A printer in accordance with an embodiment of the invention includes any one of the droplet ejection heads described above.

DESCRIPTION OF EXEMPLARY EMBODIMENTS

Preferred embodiments of the invention are described below with reference to the accompanying drawings.

1. First Embodiment 1.1. Actuator and Droplet Ejection Device

Figure 1:
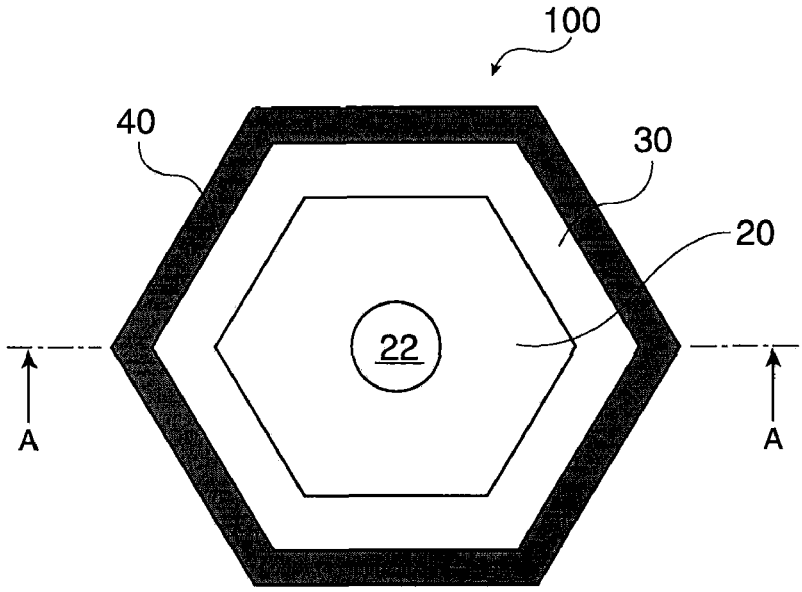
FIG. 1 is a schematic plan view of a droplet ejection device in accordance with a first embodiment of the invention.
Figure 2:
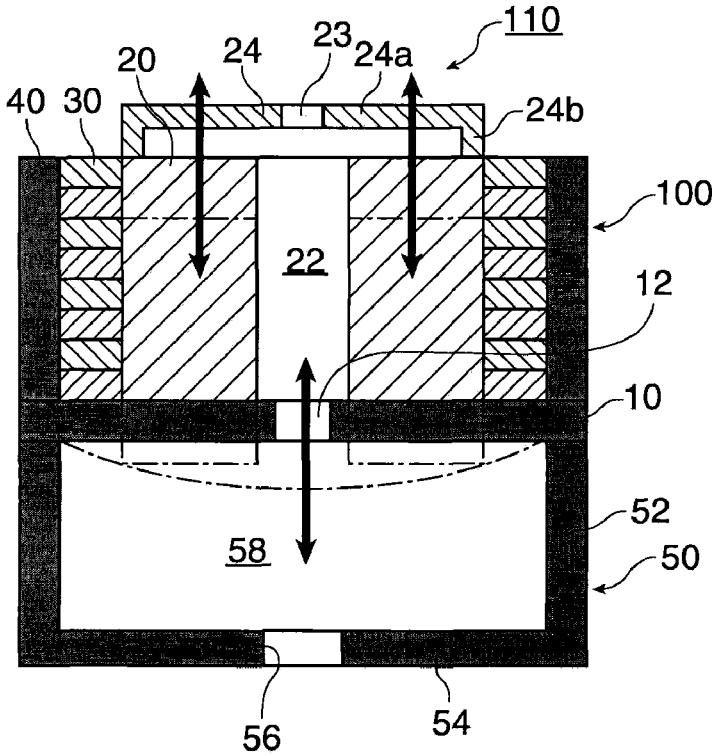
FIG. 2 is a schematic cross-sectional view of the droplet ejection device taken along a line A-A in FIG. 1.

FIG. 1 and FIG. 2 schematically show an actuator in accordance with an embodiment of the invention and a droplet ejection device having the actuator. FIG. 1 is a plan view of a droplet ejection device 100, and FIG. 2 is a cross-sectional view of the droplet ejection device taken along a line A-A of FIG. 1.

The actuator 100 in accordance with the present embodiment includes a deformable substrate 10, a magnetic body 20 provided on the substrate 10, a coil 30 that is provided on the substrate 10 and surrounds the outer circumference of the magnetic body 20, and a fixing section 40 to which the coil 30 is fixed.

The substrate 10 is capable of deforming and vibrating according to up and down movements of the magnetic body 20. The substrate 10 may be composed of any material without any particular limitation as long as the substrate 10 can deform in synchronism with up and down movements of the magnetic body 20. As a material for the substrate 10, for example, a plate of pure metal (for example, aluminum), a plate of metal oxide (for example, zirconia), and a resin film (for example, polycarbonate and polyphenylene sulfide) may be used.

The magnetic body 20 is formed from a cylindrical body having an opening section 22 along a center line extending in an up-down direction in the figure. In the illustrated example, the outer plan configuration thereof is a hexagonal shape, but its configuration is not particularly limited. Other polygonal shapes, such as, a pentagon, an octagon and the like, may also be used. As the magnetic body 20 has the opening section 22, a preferable magnetic field can be obtained, and the weight of the magnetic body 20 can be reduced. Furthermore, when the actuator 100 is applied to a droplet ejection device to be described below, the opening section 22 can have a function as a cavity for liquid. In this case, the substrate 10 may have an opening section 12 that communicates with the opening section 22. The material for the magnetic body 20 is not particularly limited to any material, but may be formed from permanent magnetic material or magnetostriction material. As the permanent magnet material, for example, iron, ferrite, NdFeB and the like may be used. As the magnetostriction material, for example, FeGa group iron alloy, nickel, iron, ferrite and the like may be used.

The magnetic body 20 may be further provided with a cap member 24 composed of magnetic material provided above the magnetic body 20. The cap member 24 includes, as shown in FIG. 2, a cap section 24*a* having the same plane configuration as that of the magnetic body 20, and a protruded section 24*b* formed along the periphery of the cap section 24*a*. As the magnetic body 20 includes the above-described cap member 24, the magnetic field of the magnetic body 20 can be made stronger. The cap member 24 has, at its center, an opening section 23 that communicates with the opening section 22.

The coil 30, in combination with the magnetic body 20, is movable relative to the magnetic body 20 according to the Fleming's left hand rule. Without any particular limitation, the coil 30 may be formed from a coiled wire, a thin film electromagnetic coil or the like. The thin film electromagnetic coil is formed from a laminate structure of coiled metal thin films, and conductive plugs that connects the layers of the laminate structure. The metal thin film may be composed of aluminum. As the material for the conductive plugs, tungsten may be used.

The fixing section 40 is provided at the outer circumference of the coil 30, and is formed from a cylindrical body. In the illustrated example, the fixing section 40 has a hexagonal plane configuration, and its lower end is affixed to the substrate 10. The coil 30 is disposed inside the fixing section 40 in a way up and down movements of the coil 30 are regulated. The coil 30 may be affixed by any means to the fixing section 40, for example, the coil 30 may be affixed to the fixing section 40 by adhesive or a mechanical stopper (not shown). The fixing section 30 may be formed from any material without any particular limitation, for example, inorganic material or organic material without magnetic property.

Next, a droplet ejection device 110 using the actuator 100 is described.

The droplet ejection device 110 is formed with the actuator 100. More specifically, in addition to the structure of the actuator 100, a pressure chamber 50 is provided below the substrate 10. The pressure chamber 50 includes a side wall 52 and a bottom wall 54. With an upper wall formed from the substrate 10, the side wall 52 and the bottom wall 54, a cavity 58 is formed. The cavity 58 communicates with the opening section 12 of the substrate 10. Furthermore, the bottom wall 56 includes a nozzle aperture 56 for ejecting liquid.

The pressure chamber 50 may be manufactured by any method without any particular limitation. The pressure chamber 50 may be formed, for example, by the following method. The side wall 52 composing the pressure chamber 50 may be formed through processing, for example, a silicon substrate (processed substrate) by etching or the like. The bottom wall 54 may be formed through affixing a plate material (nozzle plate) having the nozzle aperture 56 formed therein below the processed substrate (not shown) having the side wall 52.

Liquid is supplied in the cavity 58 of the pressure chamber 50 by a liquid supply device (not shown). For example, a liquid tank (not shown) may be provided above the actuator 100, and the liquid can be supplied to the cavity through a supply path (not shown), the opening section 23 in the cap member 24 and the opening section 22 of the magnetic body 20.

The actuator 100 in accordance with the present embodiment and the droplet ejection device 110 having the actuator 100 are operated in the following manner.

When an electric current flows through the coil 30, the coil 30 and the magnetic body 20 move with respect to each other in the up and down direction. As the coil 30 is affixed, the magnetic body 20 moves in the up and down direction. As the magnetic body 20 is affixed to the deformable substrate 10, the substrate 10 deforms in synchronism with movements of the magnetic body 20. Accordingly, the substrate 10 would vibrate in the up and down direction, as indicated in FIG. 2. When the substrate 10 is deformed toward the lower side, the volume of the cavity 58 of the pressure chamber 50 becomes smaller, such that the liquid filled in the cavity 58 is pushed out through the nozzle aperture 56. In this manner, according to the droplet ejection device 110, by driving the actuator 100, droplets can be ejected outside from the pressure chamber 50.

1.2. Droplet Ejection Head

Figure 3:
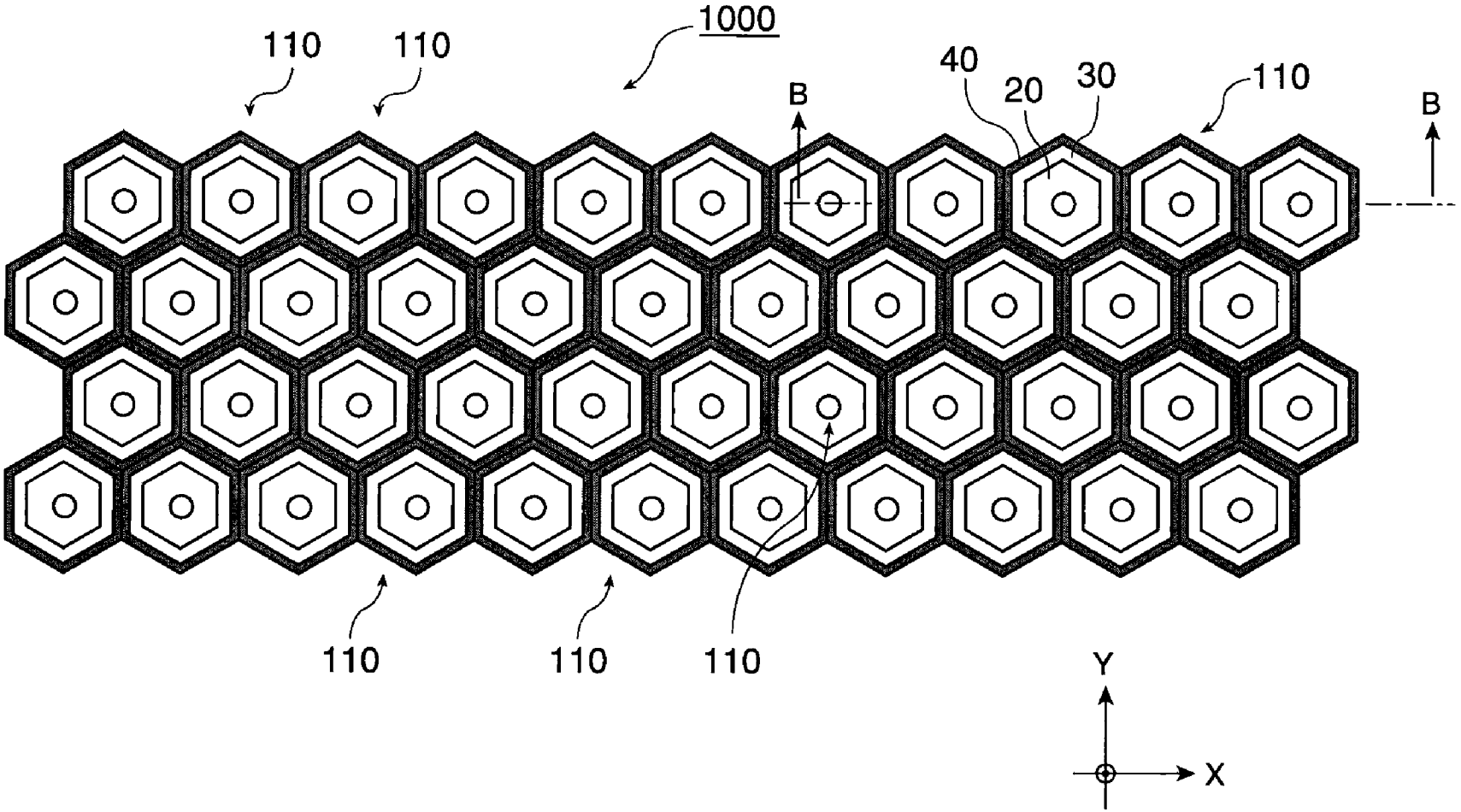
FIG. 3 is a schematic plan view of a droplet ejection head in accordance with an embodiment of the invention.
Figure 4:
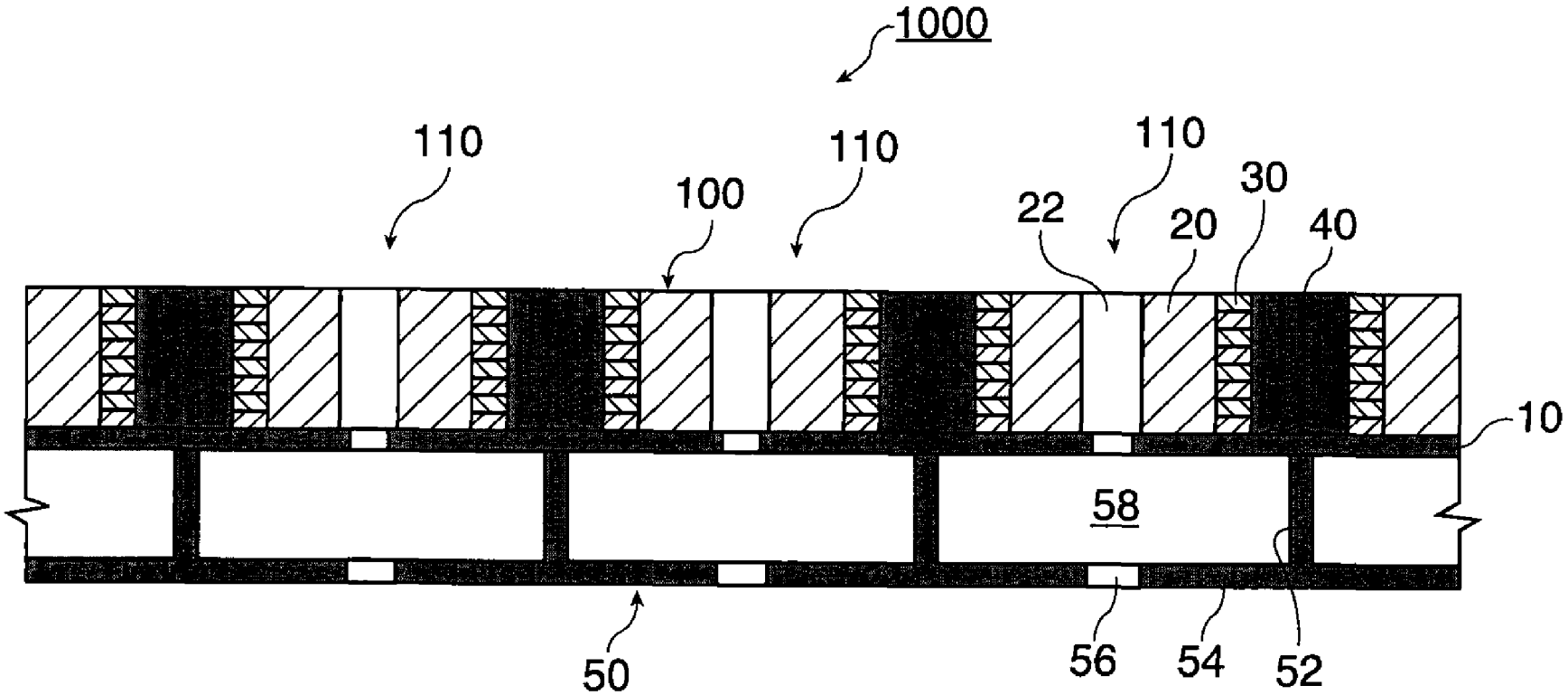
FIG. 4 is a cross-sectional view of the droplet ejection head taken along a line B-B in FIG. 3.

FIG. 3 and FIG. 4 schematically show a droplet ejection head 1000 using the droplet ejection device 110 in accordance with the present embodiment. FIG. 3 is a plan view of the droplet ejection head 1000, and FIG. 4 is a cross-sectional view taken along a line B-B of FIG. 3. Members that are substantially the same as those shown in FIG. 1 and FIG. 2 shall be appended with the same reference numbers and their detailed description shall be omitted. It is noted that, in FIG. 3, the fixing sections 40 of adjacent droplet ejection devices 110 are shown to be independent from one another, but adjacent fixing sections 40 may be formed in one piece, as shown in FIG. 4.

The droplet ejection head 1000 has the droplet ejection devices 110 described above which are arranged in a honeycomb configuration. In other words, the nozzle apertures 56 of the droplet ejection devices 110 are arranged in a first direction (X direction in FIG. 3), forming a plurality of nozzle columns. Further, adjacent ones of the nozzle columns in a second direction (Y direction in FIG. 3) are arranged, mutually shifted by half a pitch thereof. Similarly, in the X direction, adjacent ones of the nozzle columns are arranged mutually shifted by half a pitch thereof. Therefore, in accordance with the present embodiment, the nozzles have an arrangement density equal to half the pitch of the nozzle columns in the X direction and the Y direction, respectively. By arranging the droplet ejection devices 110 in a honeycomb configuration, the droplet ejection devices 110 can be closely packed. Also, the droplet ejection devices 110 arranged in each of the columns can be made to eject mutually different liquid, respectively.

According to the droplet ejection head 1000 in accordance with the present embodiment, as described above, when an electric current is circulated in the coil 30 of each selected one of the droplet ejection devices 110, the magnetic body 20 moves in the up and down direction. As the magnetic body 20 is affixed to the deformable substrate 10, the substrate 10 is deformed downwardly as the magnetic body 20 moves downwardly. When the substrate is deformed downwardly, the volume of the cavity 58 of the pressure chamber 50 reduces, and the liquid filled in the cavity 58 is pushed out of the nozzle aperture 56. In this manner, according to the droplet ejection head 1000, droplets can be ejected outside from the pressure chambers 50 through driving the droplet ejection devices 110.

2. Second Embodiment 2.1. Actuator and Droplet Ejection Device

Figure 5:
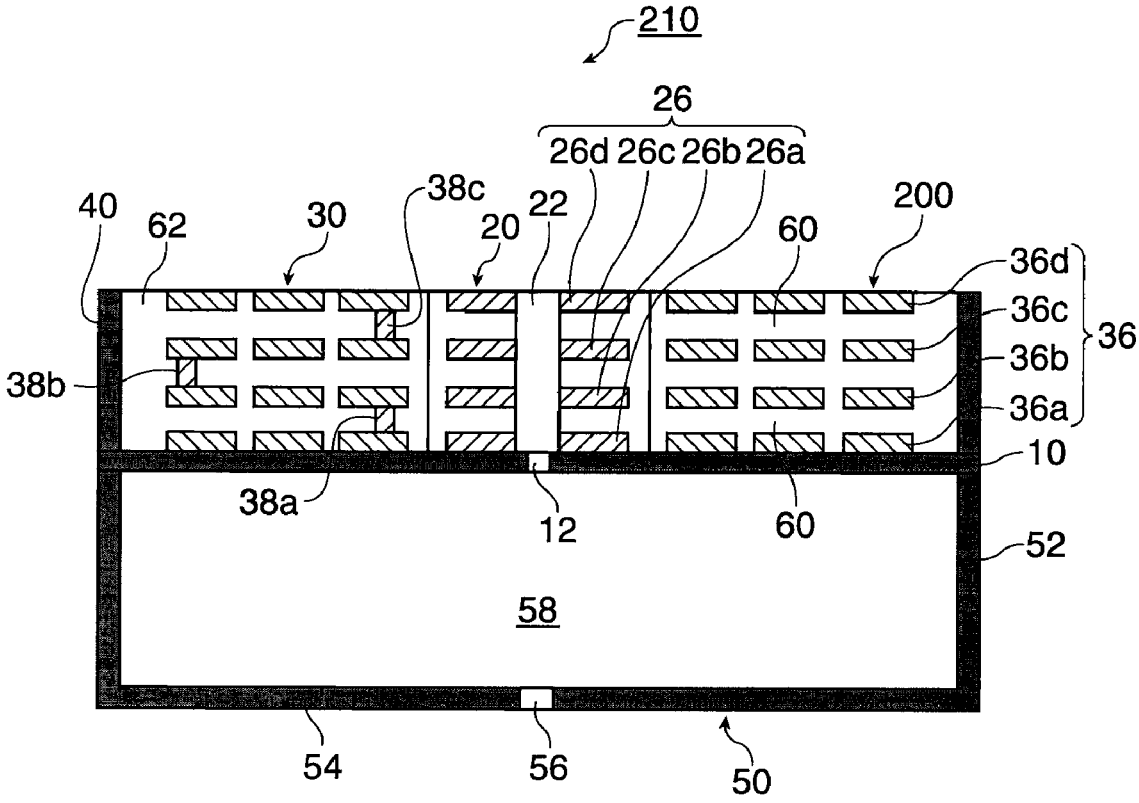
FIG. 5 is a schematic cross-sectional view of a droplet ejection device in accordance with a second embodiment of the invention.
Figure 6A:
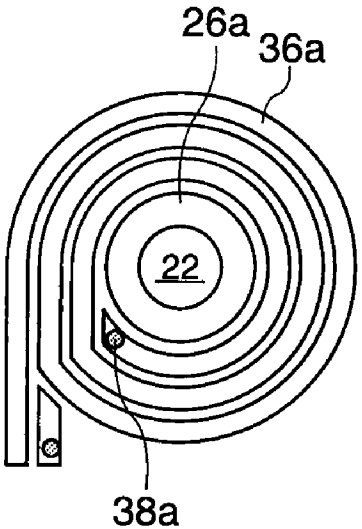
FIGS. 6A-6D are plan views of unit magnetic bodies and unit coils sequentially laminated from the side of a substrate.
Figure 6B:
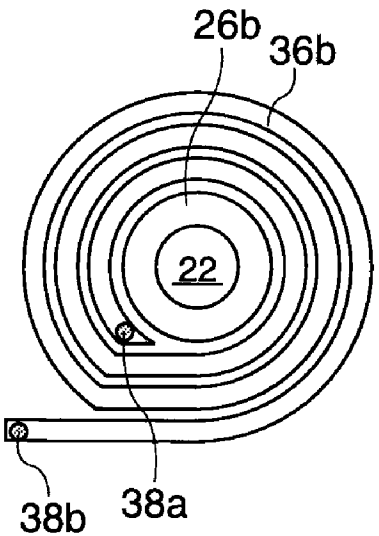
Figure 6C:
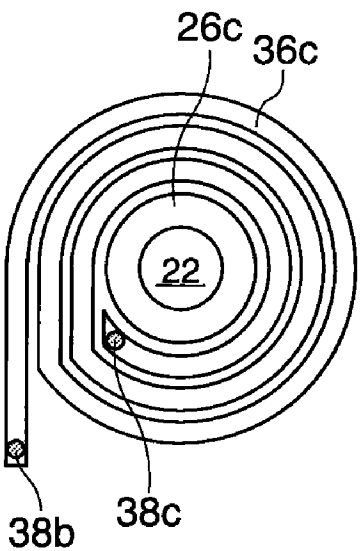
Figure 6D:
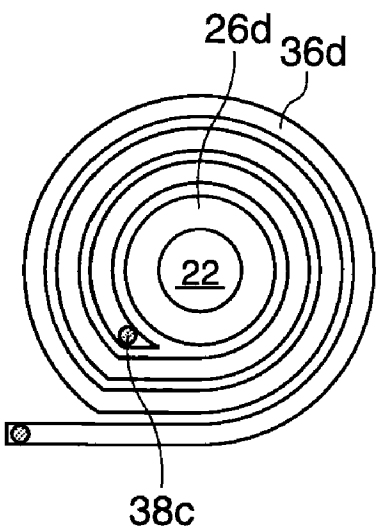

FIG. 5 and FIGS. 6A-6D are a schematic cross-sectional view and plan views of an actuator 200 in accordance with an embodiment of the invention and a droplet ejection device 210 having the actuator 200. FIGS. 6A-6D are schematic plan views of four layers of unit magnetic bodies and unit coils shown in FIG. 5, presented successively from the side of the substrate 10. Members in FIGS. 5 and 6A-6D that are substantially the same as those shown in FIG. 1 and FIG. 2 shall be appended with the same reference numbers.

The actuator 200 in accordance with the present embodiment includes a deformable substrate 10, a magnetic body 20 provided on the substrate 10, a coil 30 that is provided on the substrate 10 and surrounds the outer circumference of the magnetic body 20, and a fixing section 40 to which the coil 30 is fixed. The actuator 200 of the present embodiment is different from the actuator 100 of the first embodiment in that the actuator 200 is manufactured, using a semiconductor manufacturing technology.

The substrate 10 is capable of deforming and vibrating according to up and down movements of the magnetic body 20, like the first embodiment described above. The substrate 10 may be composed of any material without any particular limitation as long as the substrate 10 can deform in synchronism with up and down movements of the magnetic body 20.

The magnetic body 20 is formed from a cylindrical body having an opening section 22 along a center line extending in an up-down direction. As the magnetic body 20 has the opening section 22, the weight of the magnetic body 20 can be reduced. Moreover, when the actuator 200 is applied to the droplet ejection device 210, the opening section 22 can function as a cavity for liquid. In this case, the substrate 10 may have an opening section 12 that communicates with the opening section 22. The material for the magnetic body 20 is not particularly limited to any material, but may be formed from permanent magnetic material or magnetostriction material.

The magnetic body 20 may be further provided with a cap member (not shown) composed of magnetic material provided above the magnetic body 20, as shown in FIG. 2.

The magnetic body 20 has a plurality of unit magnetic bodies 26 that are divided in an up-down direction. In the illustrated example, there are provided four unit magnetic bodies 26, which are, from the side of the substrate 10, a first unit magnetic body 26*a*, a second unit magnetic body 26*b*, a third unit magnetic body 26*c* and a fourth unit magnetic body 26*d*. An interlayer dielectric layer 60 made of silicon oxide or the like may be formed in gaps between the unit magnetic bodies 26*a* and the unit magnetic body 26*d*. The unit magnetic bodies 26 are divided by the interlayer dielectric layer 60 in this manner, but can function as the magnetic body 20 as a whole.

Similarly, the coil 30 is made of a plurality of unit coils 36 that are divided in the up-down direction. In the illustrated example, there are provided four unit coils 36, which are, from the side of the substrate 10, a first unit coil 36*a*, a second unit coil 36*b*, a third unit coil 36*c* and a fourth unit coil 36*d*. An interlayer dielectric layer 60 made of silicon oxide or the like may be formed in gaps between the unit coil 36*a* and the unit coil 36*d*.

As shown in FIGS. 6A-6D, each of the unit coils 36*a*-36*d* is formed in a coil around each of the unit magnetic bodies 26*a*-26*d*. Further, the unit coils 36 are mutually connected by connectors 38 having magnetic property. More specifically, as shown in FIG. 5, the first unit coil 36*a* and the second unit coil 36*b* are connected by a first connector 38*a*, the second unit coil 36*b* and the third unit coil 36*c* are connected by a second connector 38*b*, and the third unit coil 36*c* and the fourth unit coil 36*d* are connected by a third connector 38*c*. Accordingly, the unit coils 36*a*-36*d* are mutually connected by the connectors 38*a*-38*c*, thereby forming the coil 20 as a whole.

Moreover, the outermost layer of the coil 30 is formed from a dielectric layer 62 composed of, for example, silicon oxide. On the outer circumference of the dielectric layer 62 is provided a fixing section 40.

In the illustrated example, the unit magnetic bodies 26 and the unit coils 36 are provided in four layers, but the number of layers can be arbitrarily set.

Next, a droplet ejection device 210 that uses the above-described actuator 200 is described. The droplet ejection device 210 is basically the same as the droplet ejection device 110 in accordance with the first embodiment.

The droplet ejection device 210 is formed with the actuator 200 described above, as shown in FIG. 5. More specifically, in addition to the structure of the actuator 200, a pressure chamber 50 is provided below the substrate 10. The pressure chamber 50 includes a side wall 52 and a bottom wall 54. With an upper wall defined by the substrate 10, the side wall 52 and the bottom wall 54, a cavity 58 is formed. The cavity 58 communicates with the opening section 12 of the substrate 10. Furthermore, the bottom wall 56 includes a nozzle aperture 56 for ejecting liquid.

The pressure chamber 50 may be manufactured by any method without any particular limitation, and may be manufactured by a method similar to the method described in the first embodiment.

The actuator 200 in accordance with the present embodiment and the droplet ejection device 210 having the actuator 200 are operated in the following manner.

When an electric current flows through the coil 30, the coil 30 and the magnetic body 20 move with respect to each other in an up-down direction. As the coil 30 is affixed, the magnetic body 20 moves in the up-down direction. As the magnetic body 20 is affixed to the deformable substrate 10, the substrate 10 deforms in synchronism with movements of the magnetic body 20. Accordingly, the substrate 10 would vibrate in the up-down direction. When the substrate 10 is deformed toward the lower side, the volume of the cavity 58 of the pressure chamber 50 becomes smaller, such that liquid filled in the cavity 58 is pushed out through the nozzle aperture 56. In this manner, according to the droplet ejection device 210, by driving the actuator 200, droplets can be ejected outwardly from the pressure chamber 50.

The droplet ejection device 210 of the present embodiment can also be applied to a droplet ejection head, like the first embodiment. As the actuator 200 of the droplet ejection device 210 of the present embodiment can be manufactured by using a semiconductor manufacturing technology, as described below, the size of the droplet ejection device 210 can be reduced. As a result, the droplet ejection head can be reduced in size while achieving a higher arrangement density of nozzle apertures.

2.2. Method For Manufacturing Droplet Ejection Device

First, a method for manufacturing the actuator 200 is described.

The actuator 200 may be manufactured, using a semiconductor manufacturing technology, for example, by the following method. First, as shown in FIG. 5, a first unit magnetic body 26*a* is formed on a substrate 10. The first unit magnetic body 26*a* may be formed through forming a film composed of magnetic material by a sputter method or a vapor deposition method, and then patterning the formed film. Then, a portion where the first magnetic body 26*a* is masked, a first unit coil 36*a* is formed on the substrate 10. The first unit coil 36*a* may be obtained through film forming and patterning, like the first unit magnetic body 26*a*. The order in forming the first unit magnetic body 26*a* and the first unit coil 36*a* may be reversed.

Then, a dielectric film, such as, a silicon oxide film is formed on the first unit magnetic body 26*a* and the first unit coil 36*a* by a known method, thereby forming an interlayer dielectric layer 60. The interlayer dielectric layer 60 may be planarized by a CMP method or the like depending on the necessity. Then, a hole is formed in the interlayer dielectric layer 60 by a known method, and magnetic material is filled in the hole by a sputter method, whereby a first connector 38*a* is formed. The steps described above are similarly repeated, thereby sequentially forming the remaining unit magnetic bodies 26*b*-26*d*, unit coils 36*b*-36*d*, and connectors 38*b* and 38*c*.

Then, the dielectric layer 60 formed in a central area in the laminate of the unit magnetic bodies 26*a*-26*d* is anisotropically etched, thereby removing a portion thereof to form an opening section 22. Furthermore, the laminate of the unit magnetic bodies 26*a*-26*d* and the unit coils 36*a*-36*d* is cut out by a dicing saw or the like. In this manner, the magnetic body 20 and the coil 30 can be formed.

According to the manufacturing method using a semiconductor manufacturing technology, an actuator 200 of a small size can be manufactured with high precision, and a plurality of actuators 200 can be formed at desired positions by using the same process at once.

A pressure chamber 50 may be formed below the thus manufactured actuator 200, like the first embodiment, whereby the droplet ejection device 210 can be obtained.

Moreover, by arranging a plurality of droplet ejection devices 210, a droplet ejection head, which is similar to the droplet ejection head described in the first embodiment, can be obtained.

3. Printer

A printer in accordance with an embodiment of the invention having a liquid jet head in accordance with the invention is described. The embodiment is described here using an example in which a printer 300 in accordance with the present embodiment is an ink jet printer.

Figure 7:
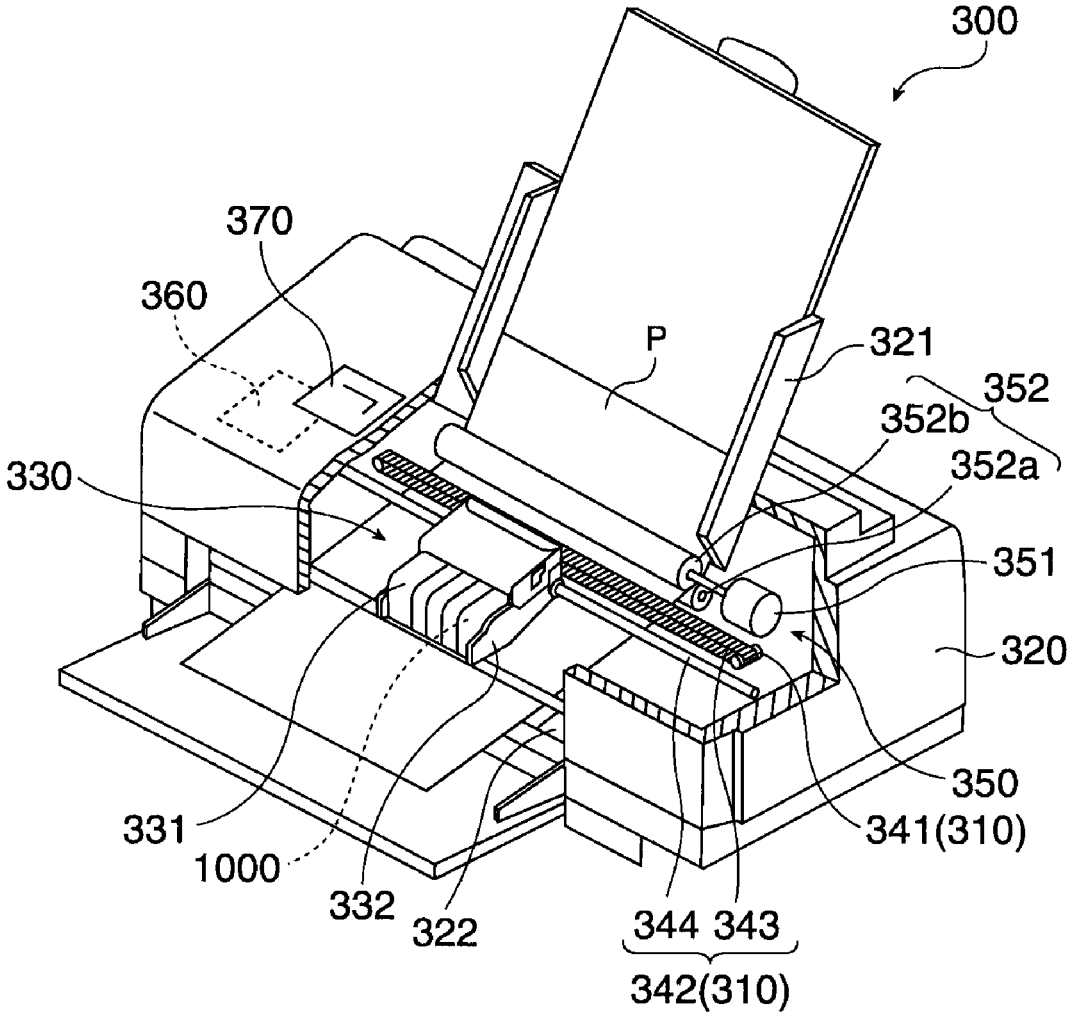
FIG. 7 is a schematic perspective view of a printer in accordance with an embodiment of the invention.

FIG. 7 is a schematic perspective view of the printer 300 in accordance with the present embodiment.

The printer 300 includes a head unit 330, a driving section 310, and a controller section 360. Also, the printer 300 may include an apparatus main body 320, a paper feed section 350, a tray 321 for holding media P (recording paper), a discharge port 322 for discharging the media P, and an operation panel 370 disposed on an upper surface of the apparatus main body 320.

The head unit 330 includes an ink jet recording head (hereafter simply referred to as the "head") that is composed of liquid jet heads 1000 in accordance with the embodiment described above. The head unit 330 is further equipped with ink cartridges 331 that supply inks to the head, and a transfer section (carriage) 332 on which the head and the ink cartridges 331 are mounted.

The driving section 310 is capable of reciprocally moving the head unit 330. The driving section 310 includes a carriage motor 341 that is a driving source for the head unit 330, and a reciprocating mechanism 342 that receives rotations of the carriage motor 341 to reciprocate the head unit 330.

The reciprocating mechanism 342 includes a carriage guide shaft 344 with its both ends being supported by a frame (not shown), and a timing belt 343 that extends in parallel with the carriage guide shaft 344. The carriage 332 is supported by the carriage guide shaft 344, in a manner that the carriage 332 can be freely reciprocally moved. Further, the carriage 332 is affixed to a portion of the timing belt 343. By operations of the carriage motor 341, the timing belt 343 is moved, and the head unit 330 is reciprocally moved, guided by the carriage guide shaft 344. During these reciprocal movements, ink is jetted from the head and printed on the medium P.

The control section 360 can control the head unit 330, the driving section 310 and the paper feeding section 350.

The paper feeding section 350 can feed the media P from the tray 321 toward the head unit 330. The paper feeding section 350 includes a paper feeding motor 351 as its driving source and a paper feeding roller 352 that is rotated by operations of the paper feeding motor 351. The paper feeding roller 352 is equipped with a follower roller 352*a* and a driving roller 352*b* that are disposed up and down and opposite to each other with a feeding path of the medium P being interposed between them. The driving roller 352*b* is coupled to the paper feeding motor 351. When the paper feeding section 350 is driven by the control section 360, the medium P is fed in a manner to pass below the head unit 330.

The head unit 330, the driving section 310, the control section 360 and the paper feeding section 350 are provided inside the apparatus main body 320.

The printer 300 has, for example, the following characteristics.

The printer 300 may have a droplet ejection head in accordance with an embodiment of the invention. The droplet ejection head in accordance with the embodiment is highly reliable, and can be manufactured at low costs and with a relatively simple process. Therefore, the printer 300 that is highly reliable and can be manufactured at low costs with a simple process can be obtained.

It is noted that, in the example described above, the case where the printer 300 is an ink jet printer is described. However, the printer in accordance with the invention may also be used as an industrial liquid ejection device. Liquid (liquid material) that may be ejected in this case may be liquid composed of any one of functional materials of various kinds whose viscosity is appropriately adjusted with a solvent or a dispersion medium.

The invention is not limited to the embodiments described above, and many modifications can be made. For example, the invention may include compositions that are substantially the same as the compositions described in the embodiments (for example, a composition with the same function, method and result, or a composition with the same objects and result). Also, the invention includes compositions in which portions not essential in the compositions described in the embodiments are replaced with others. Also, the invention includes compositions that achieve the same functions and effects or achieve the same objects of those of the compositions described in the embodiments. Furthermore, the invention includes compositions that include publicly known technology added to the compositions described in the embodiments.

What is claimed is:

1. A droplet ejection device comprising:

a pressure chamber that includes a cavity surrounded by a side wall and a bottom wall;

an aperture that is provided at the bottom wall;

a deformable substrate that is provided above the pressure chamber to cover the cavity and that is parallel to the bottom wall;

a first opening that is provided on the deformable substrate;

a magnetic body having a second opening that is provided above the deformable substrate and that is fixed to the deformable substrate; and a coil that is disposed above the deformable substrate, that surrounds the magnetic body, and that is fixed to a fixing portion provided above the side wall, wherein the deformable substrate is configured to be vibrated by the magnetic body to increase and decrease the pressure in the pressure chamber to cause droplet ejection.

2. The droplet ejection device according to claim 1, wherein the magnetic body is formed from a plurality of unit magnetic bodies that are divided along an up-down direction, and the coil is formed from unit coils that are divided in the up-down direction, wherein adjacent ones of the unit coils in the up-down direction are connected to each other in the up-down direction by a connector formed from a magnetic material.

3. The droplet ejection device according to claim 1, wherein the droplet ejection device has a hexagonal plane configuration.

4. A droplet ejection head comprising a plurality of the droplet ejection devices recited in claim 1.

5. The droplet ejection device according to claim 1, wherein the aperture is open to the air so as to eject a droplet through the aperture.

6. The droplet ejection device according to claim 2, wherein an interlayer dielectric layer is provided between the unit magnetic body and the unit coil in the up-down direction.

7. A droplet ejection head according to claim 4, wherein the plural droplet ejection devices are arranged in a honeycomb configuration in a plan view.

8. A printer comprising the droplet ejection head recited in claim 4.

* * * * *